United States Patent [19]

Ziegler, Jr.

[11] 4,056,902

[45] Nov. 8, 1977

[54] TREE HOUSE KIT

[75] Inventor: William H. Ziegler, Jr., Bedford, Pa.

[73] Assignee: Hedstrom Company, Bedford, Pa.

[21] Appl. No.: 676,338

[22] Filed: Apr. 12, 1976

[51] Int. Cl.[2] ..... E04B 1/34

[52] U.S. Cl. ..... 52/73; 182/188; 248/220.1

[58] Field of Search ..... 52/73; 182/82, 187, 182/188; 248/241, 221, 221 A

[56] References Cited

U.S. PATENT DOCUMENTS

| | | | |
|---|---|---|---|
| 776,764 | 12/1904 | Squire | 182/188 |
| 1,826,120 | 10/1931 | Booth | 182/187 |
| 2,066,984 | 1/1937 | Lamb | 182/187 |
| 2,414,538 | 1/1947 | Lamb | 182/187 |
| 3,566,991 | 3/1971 | Proulx | 182/129 |
| 3,595,510 | 7/1971 | Hutchinson | 182/82 |
| 3,776,498 | 12/1973 | Peters | 182/82 |

FOREIGN PATENT DOCUMENTS

| | | | |
|---|---|---|---|
| 1,285,490 | 1/1962 | France | 182/82 |
| 926,917 | 10/1947 | France | 182/188 |
| 922,549 | 7/1949 | Germany | 182/82 |
| 258,565 | 4/1913 | Germany | 182/82 |
| 626,553 | 2/1936 | Germany | 182/188 |

*Primary Examiner*—Price C. Faw, Jr.
*Assistant Examiner*—Henry Raduazo
*Attorney, Agent, or Firm*—Cesari and McKenna

[57] ABSTRACT

A tree house kit includes a number of identical frames for attachment around a tree trunk. The array of frames supports floor panels and may also support wall and roof panels all made from templates provided in the kit to form a complete enclosure around the tree trunk. Each frame includes a self-leveling, telescoping floor panel supporting section which may be adjusted so that the array of frames can be installed on irregular tree trunks and trunks with different diameters, yet still maintain the floor in a level condition. Each frame may also include wall and roof panel supporting sections which mate with the floor supporting section and which also adapt themselves to irregularities in the tree trunk.

14 Claims, 4 Drawing Figures

TREE HOUSE KIT

BACKGROUND OF THE INVENTION

This invention relates to a children's tree house. It relates more particularly to a tree house kit containing improved frame structure which facilitates building a tree house or fort in different types of trees.

The usual way of constructing a tree house or fort is to nail wood frames between tree branches which are more or less in the same plane. Then floor boards are nailed to the frames. In the event the the tree does not have suitably placed branches to which to secure the frames, supporting frames are nailed to the tree trunk and supported from below by struts extending between the ends of the frames and the tree trunk. If the tree house is to have walls and a roof, additional framing extending up from the floor and secured to the tree above the floor is required in order to support the boards or panels forming the walls and roof.

In many cases it is relatively difficult to build a house or fort in a tree. The branches may not be in the proper position. Also the tree trunk may have bends or irregularities which make it difficult to properly position and secure framing so that it will support a level floor.

Also in some cases, the person building the tree house is not as handy or as knowledgeable as he might be about structural mechanics. Consequently, the various frames and braces comprising the tree house may not be placed properly to firmly support the weight which the tree house will ultimately have to carry. This could result in injury should the tree house collapse under the weight of children playing in the structure.

Another disadvantage of conventional tree house construction is that it is difficult to relocate the structure should the need arise. That is, each tree house is custom made to fit a particular tree. It is next to impossible to disassemble the tree house and reconstruct it in a different tree.

SUMMARY OF THE INVENTION

Accordingly, the present invention aims to provide a kit for building a children's tree house which can be set up by relatively unskilled people.

Another object of the invention is to provide kit components for building a tree house in trees having a wide variety of sizes, shapes and branching characteristics.

Yet another object of the invention is to provide a tree house which can be disassembled readily and relocated to a new tree in the event that becomes desirable.

A further object of the invention is to provide a tree house kit which can be mass produced at relatively low cost and whose basic components can be shipped in a relatively small package so that transportation costs are also kept to a minimum.

Other objects will in part be obvious and will in part appear hereinafter.

The invention accordingly comprises the features of construction, combination of elements and arrangement of parts which will be exemplified in the following detailed description, and the scope of the invention will be indicated in the claims.

Briefly the subject tree house kit consists of a package containing a set of frames, a set of templates and instructions for making the tree house. These frames which are identical, are arranged to be distributed about the trunk of a tree and secured by suitable means, such as lag screws. The frames are designed so that they can be mounted on trees having a wide variety of trunk diameters as well as trees with irregular or curved trunks, yet still support the tree house floor in a horizontal plane.

Each floor frame comprises a telescoping section and a supporting strut both of which are secured to the tree trunk so that the telescoping section lies in a horizontal plane. In a typical full frame array there may be eight such floor frames evenly distributed around the tree trunk. These frames are designed to support two standard 4 by 8 foot plywood panels which from the floor of the tree house. A template included in the kit facilitates cutting the plywood floor panels in the correct shape, i.e. an octagon. The frames are positioned so that the frame ends lie at the corners of the octagon with the tree trunk extending up through the center of the octagon. The plywood panels are secured to the frames forming a rigid platform floor.

In the event that one wishes to construct a tree house with walls and/or a roof, the kit may include a set of side and roof frames which cooperate with the floor frames to provide a strong rigid enclosure. Each side frame is simply a tube whose lower end connects with a floor frame. Plywood side panels, cut following a template in the kit, are secured to the side frames forming a strong sturdy wall extending around the floor.

Each roof frame comprises a telescoping member, one end of which is secured to the tree trunk above the floor and the other end of which is connected to the upper end of a side frame.

Generally triangular roof panels cut following a template in the kit are secured to the roof braces to provide overhead protection against the elements. Also if desired, suitable door or window openings may be cut in the wall or floor panels to provide ventilation and access to the tree house.

The present kit greatly simplifies the construction of a tree house. Furthermore, a perfectly safe tree house can be erected using the kit even by persons not naturally handy with tools because most of the important parts are performed at the factory; the purchaser only has to cut the various panels in the proper shape in accordance with the kit templates and secure the frames to the tree trunk following the kit directions.

Due to the configuration of the various frames to be described later, a level tree house can be erected in trees having a wide variety of trunk diameters and even in trees having irregular trunks. Yet with all these advantages, the cost of constructing the tree house should be no greater than the cost of making a tree house using framing consisting of wooden studs.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENTS

Figure 1:
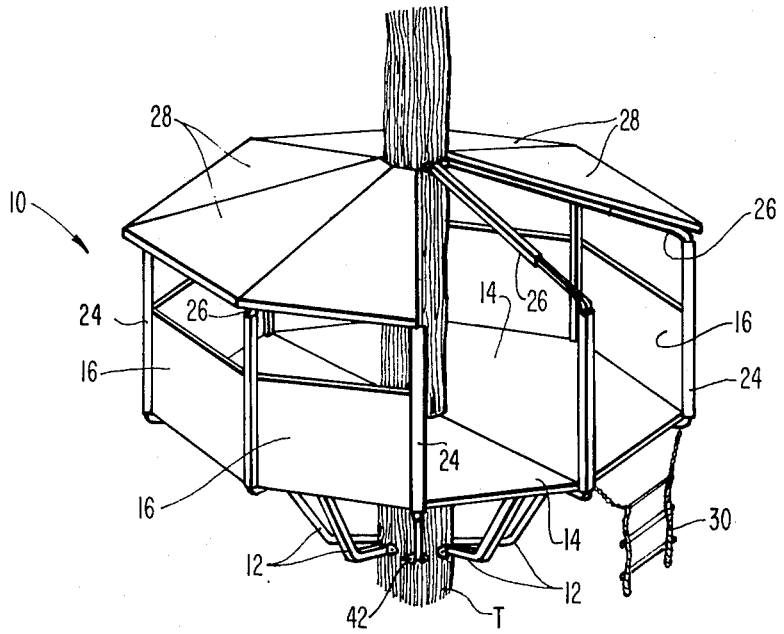
FIG. 1 is a perspective view with parts cut away of a tree house made in accordance with this invention.

Referring now to FIG. 1 of the drawings, the tree house indicated generally at 10 is supported above the ground by a tree trunk T. The tree house includes an array of floor frames shown generally at 12 which are secured to trunk T and support a pair of floor panels 14 so that they lie in a horizontal plane.

The tree house may also include wall panels 16 secured to vertical side frames 24 which are in turn supported by the bottom frames 12.

If the tree house is to have a roof, a set of roof frames 26 are connected to the upper ends of the side frames 24 and to tree trunk T above the floor panels 14 as will be described later. Identical generally triangular roof panels 28 are then secured to the roof frames to complete the tree house enclosure.

Thus if the tree house extends all around the tree trunk, it is generally octagonal in shape. The frames 12 are designed and arranged so that each floor panel 14 can be cut from a single standard 4 to 8 foot sheet of plywood with a minimum amount of waste material. Likewise the wall panels are identical as are the roof panels and these also can be cut from standard plywood sheets. A ladder 30 (FIG. 1) may be used to reach the tree house from the ground.

Figure 2:
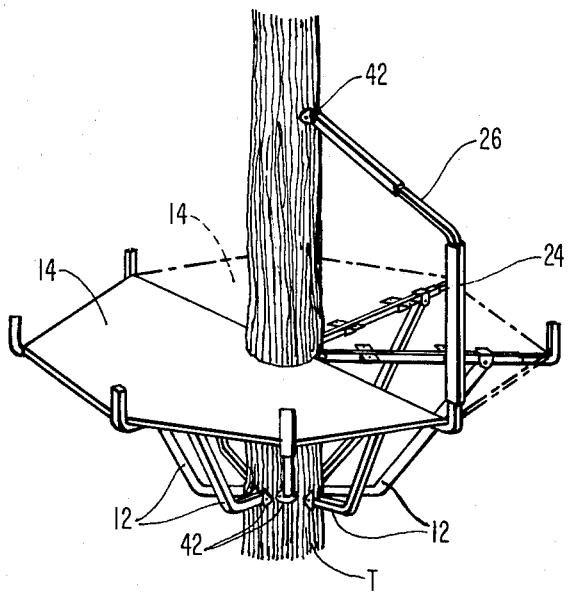
FIG. 2 is a similar view of the tree house with the wall and roof panels removed.

In some cases it may not be possible to extend the tree house all the way around the trunk because of branching or other obstructions. In that event, the floor frames 12 would extend only partway around the tree trunk as would the floor panels which they support. FIG. 2 illustrates in solid lines a tree house that only extends halfway around the tree trunk. Accordingly, the tree house has only five floor frames 12 which support a single floor panel 14. The second floor panel 14 is shown in dotted lines in that figure in the position that it would occupy if the tree house did extend all the way around the tree trunk. Also in the structure illustrated in FIG. 2, the tree house is open, having no wall or roof panels. A single wall frame 24 and a single roof frame 26 are shown in the positions they would normally occupy in a fully enclosed tree house to illustrate the mode of interconnecting the frames.

Figure 3:
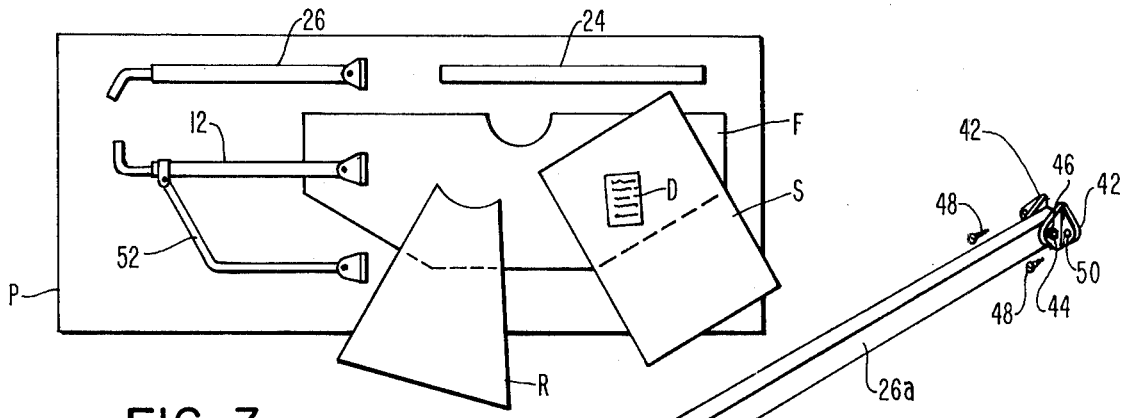
FIG. 3 is a perspective view on a small scale of a kit for building the FIG. 1 tree house.

FIG. 3 shows the basic tree house kit. It contains a set of eight floor frames 12, a floor panel template F, a side panel template S and a roof panel template R, along with assembly instructions D, all of these materials being contained in a package P. This basic kit allows one to construct a tree house platform extending all around the tree trunk. If one also wishes to include walls on the tree house then he would purchase separately eight side frames 24. Finally, if he wishes to construct a fully enclosed tree house, he would also purchase a set of eight roof frames 26. Of course, a larger, more expensive kit could be offered containing all the frames required to build a fully enclosed tree house.

Figure 4:
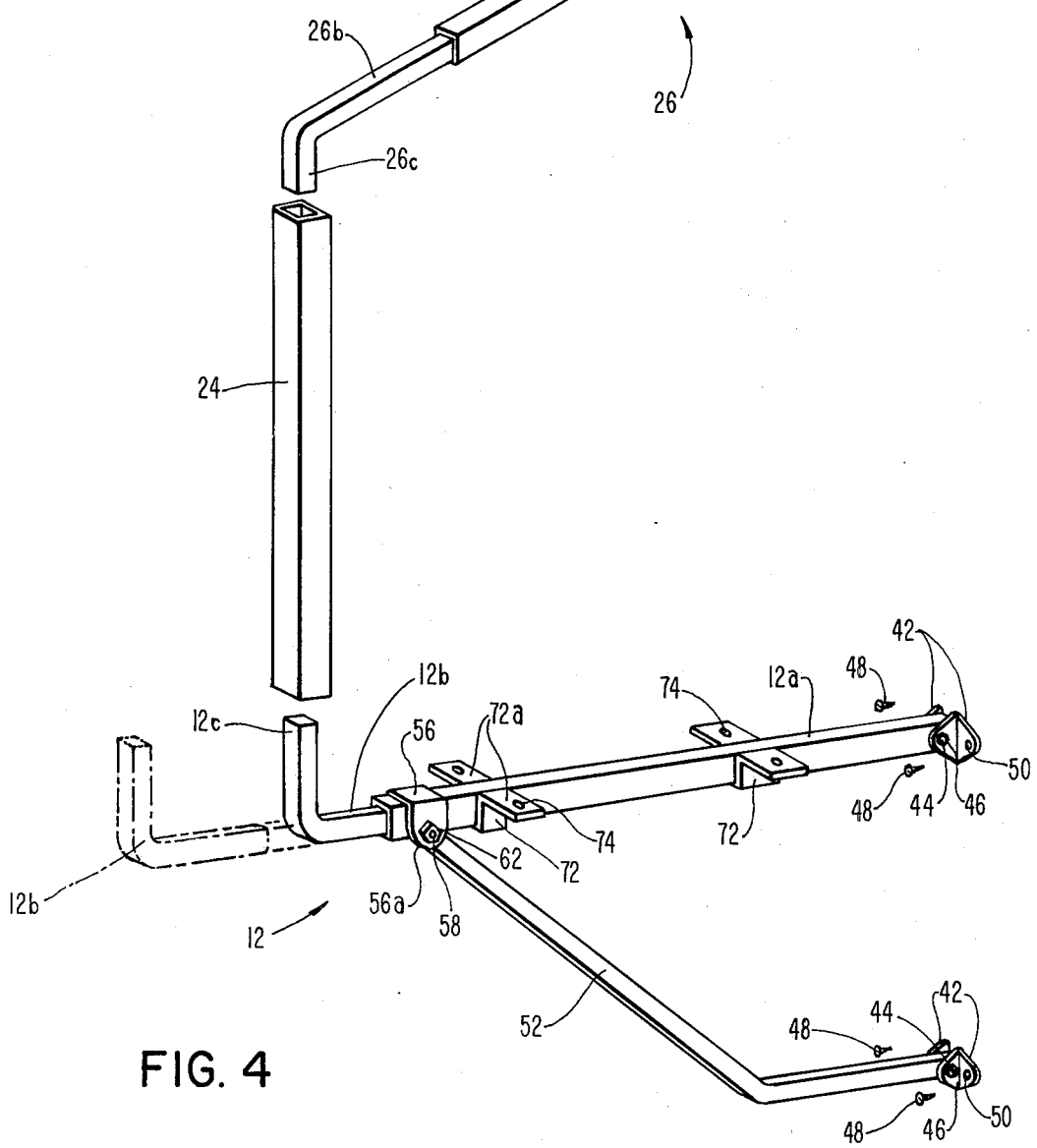
FIG. 4 is an exploded perspective view on a much larger scale detailing the frames comprising the FIG. 1 tree house.

Turning now to FIG. 4, each floor frame 12 comprises a first section **12*a* consisting of a straight tube having a square cross-section. A second frame section 12*b* having a slightly smaller cross-sectional area is slidably received in the end of section 12*a*. The exposed end of section 12*b* is turned upward to form an upstanding leg 12*c*. In a typical embodiment, section 12*a* is on the order of twenty-eight inches long, section 12*b* is approximately twenty-six inches long and leg 12*c*** is seven inches long.

A pair of right angle brackets 42 are pivotally connected to the free or right-hand end of frame section **12*a*. More particularly, these brackets lie flush against opposite sides of section 12*a* and a bolt 44 extends through aligned openings in the brackets and in the sides of section 12*a*. The bolt 44 is held in place by a suitable nut 46. These brackets 42 are arranged to be secured to the tree trunk T by lag screws 48 extending through openings 50** in the bracket legs.

Frame 12 also includes a strut 52 which is bent at an obtuse angle so that the right-hand portion thereof, as shown in FIG. 4, lies parallel and below frame section **12*a* while the left-hand portion of the strut extends up to the left-hand end of section 12*a*. A strap 56 engages around the end of section 12*a* and is secured thereto by welds or other suitable means. The strap includes ears 56*a* which extend down on opposite sides of strut 52. The strut is pivotally secured to those ears by means of a bolt 58 extending through aligned openings in ears 56*a* and strut 52 and a nut 62 retains the screw. The right-hand end of strut 52 is arranged to be connected to the tree trunk by brackets 42 identical to those at the end of frame section 12*a*.**

In use, the frame section **12*b* can telescope out until its leg 12*c* extends just beyond one of the corners of the floor panels 14 at which point it will project up above and capture the floor panel as best seen in FIG. 2. The ability of the frame to telescope in this manner compensates for the fact that the tree trunk may not have a circular cross-section in which case some frames 12 might otherwise extend out radially more than the others. In actual practice it has been found that as long as the tree trunk is at least one foot in diameter, the frame 12 can be adjusted so that the standard floor panels 14** can be snugly positioned on the frames and lie generally in a horizontal plane.

The floor panels are secured to the frame sections **12*a* and 12*b* by suitable straps 72 which engage under the frame sections. The straps have laterally extending ears 72*a* containing openings 74** for receiving bolts extending down through the floor panels. Alternatively, the panels can be held in place by screws turned down into openings in the frame section themselves.

Still referring to FIG. 4, each side frame 24 is simply a straight tube approximately three feet long and having a square cross-section. The open lower end of the side frame as arranged to receive a leg **12*c* which thereupon holds the side frame upright. The side panels 16 (FIG. 1) are secured to the side frames by brackets similar to brackets 72 or by screws extending through the side panels and turned down into the side frames. When the side frames 24 are interconnected by the various side panels 16,** a rigid upstanding wall is formed which should prevent children from falling out of the tree house.

Each roof frame 26 is composed of telescoping sections **26*a* and 26*b*. Section 26*a* is simply a straight hollow tube having a square cross-section and it is approximately 28 inches long. Section 22*b* which is received in section 22*a* is somewhat longer and has a depending leg 26*c* which is arranged to extend into the open upper end of a side frame 24. The free end of frame section 26*a* is pivotally connected to a pair of brackets 42 by a bolt 44 extending through aligned openings in the brackets and section 26*a*. As before the bolts are retained by nuts 46. These brackets are also arranged to be secured to the tree trunk by lag screws 48.**

The various roof panels 28 are secured to the roof frames 26 by straps similar to strap 72 or by screws extending through the roof panels and turned down into the openings in the frames 26.

Thus the floor, side and roof frames 12, 24, and 26 in each frame unit are rigidly interconnected and connected at their opposite ends to brackets 42 attached to the tree trunk. Furthermore, the strut 52 associated with each unit provides additional support from below. Accordingly, when all of the frames are in place and interconnected by the various panels, a very strong, rigid tree house construction results.

Thus the present tree house kit provides a convenient way for one to build a tree house for children and the frame design assures that the resultant tree house will be strong enough to support the children. By following the directions even relatively unhandy people can erect the tree house in a minimum amount of time. Yet the cost of making the structure should not be appreciably more than the cost of erecting a tree house using wooden studs and planks.

It will thus be seen that the objects set forth above among those made apparent from the preceding description are efficiently attained, and since certain changes may be made in the above construction without departing from the scope of the invention, it is intended that all matter contained in the above description or shown in the accompanying drawings should be interpreted as illustrative and not in a limiting sense.

It is also to be understood that the following claims are intended to cover all of the generic and specific features of the invention herein described.

What is claimed is:

1. A kit for making a tree house comprises in combination a packaging container containing A. a set of floor frames for mounting on a tree trunk, each floor frame comprising
  1. a first elongated rigid frame section,
  2. an elongated rigid strut having two ends,
  3. means for pivotally connecting one end of the strut to the first frame section,
  4. a second elongated rigid frame section, and
  5. means for telescopically connecting the two frame sections together beyond said connecting means,

B. first means for pivotally securing the free end of said first floor frame section to a tree trunk, C. second means for pivotally connecting the other end of said strut to the tree trunk, said first and second pivotal connecting means being separate and movable relative to one another, D. a template for a floor panel shaped to rest on the set of floor frames as mounted on the tree trunk, and E. instructions for mounting the floor frames and panels shaped from the template to make the tree house.

2. The kit defined in claim 1 wherein the container also contains

A. a set of elongated, rigid side frames,

B. means for connecting one end of each side frame to the free end of the other section of a floor frame, a template for side panels shaped for mounting on the side frames, and C. instructions for combining the side frames and floor frames and the side panels made from the template.

3. The kit defined in claim 2 wherein the container also contains

A. a set of roof frames, each said roof frame comprising first and second telescoping sections, B. means for connecting the free end of one roof frame section to a tree trunk, C. means for connecting the free end of the other roof frame section to the other end of a side frame, D. a template for roof panels shaped for mounting on the roof frames, and E. instructions for combining the roof frames, side frames and roof panels to make a covered tree house.

4. A tree house comprising

A. a set of floor frames distributed about a tree trunk, each floor frame comprising
  1. first and second rigid telescoping sections,
  2. means for pivotally connecting the free end of the first section to the tree trunk,
  3. a strut having one end pivotally secured to the other end of the first section, and
  4. means for pivotally connecting the other end of the strut to the tree trunk, the free end of the first section and the other end of the strut being separate and movable relative to one another so that the floor frames together can be adjusted on the trunk to define a horizontal plane, B. a floor panel resting on the floor frames, and C. means for securing the floor panel to the floor frames.

5. The tree house defined in claim 4 wherein each means for securing the floor frames to the tree trunk comprises a bracket pivotally connected to the floor frame.

6. The tree house defined in claim 4 wherein the free end of the second floor frame section projects up outboard of the floor panel.

7. The tree house defined in claim 6 and further including

A. a set of elongated, rigid side frames, each side frame having its lower end engaging over the upwardly projecting end of a floor frame, B. a set of side panels, and C. means for securing the side panels to the side frames to form a wall around the periphery of the floor panel.

8. The tree house defined in claim 7 and further including

A. a set of roof frames, each roof frame comprising first and second elongated, rigid telescoping roof frame sections, B. means for securing a free end of the first roof frame section to a tree trunk, C. means for securing the free end of the second roof frame section to the other end of a side frame, D. a set of roof panels positioning on the roof frames, and E. means for securing the roof panels to the roof frames.

9. The tree house defined in claim 8 wherein the free end of the second roof frame section is slidably received in the other end of the side frame.

10. A frame structure for supporting an elevated platform comprising

A. a first elongated rigid frame section,

B. a first bracket pivotally connected to one end of the first section,

C. a rigid strut having two ends,

D. means for pivotally connecting one end of the strut to the first section an appreciable distance from said one end of that section, E. a second elongated rigid frame section, said first and second sections being telescopically connected together beyond said connecting means, and F. a second bracket pivotally connected to the other end of the strut, said first and second brackets being separate and movable relative to one another.

11. The frame defined in claim 10 and further including a leg integral with the free end of the second frame section, said leg extending at an angle relative to the longitudinal axis of said second frame section.

12. The frame defined in claim 11 and further including

A. an elongated, rigid side frame, and

B. means defining an opening on one end of the side frame for receiving said leg to connect the side frame to the second frame section.

13. The frame structure defined in claim 12 and further including

A. a roof frame, said roof frame comprising first and second elongated rigid members telescopically connected together, B. a bracket pivotally connected to the free end of the first roof frame section and means for connecting the free end of the second roof frame section to the other end of the side frame.

14. The frame structure defined in claim 13 wherein the connecting means between the roof frame and the side frame comprises A. a leg integral with a free end of the second roof frame section, said leg being oriented at an angle relative to the longitudinal axis of the roof frame, and B. means defining an opening in the other end of the side frame for receiving the roof frame leg.

* * * * *